US009196448B2

(12) United States Patent
Kasahara

(10) Patent No.: US 9,196,448 B2
(45) Date of Patent: Nov. 24, 2015

(54) ELECTRON TUBE

(71) Applicant: NETCOMSEC Co., Ltd., Tokyo (JP)

(72) Inventor: Akihiko Kasahara, Tokyo (JP)

(73) Assignee: NEC Network and Sensor Systems, Ltd., Tokyo (JP)

( * ) Notice: Subject to any disclaimer, the term of this patent is extended or adjusted under 35 U.S.C. 154(b) by 0 days.

(21) Appl. No.: 14/228,460

(22) Filed: Mar. 28, 2014

(65) Prior Publication Data

US 2014/0292190 A1 Oct. 2, 2014

(30) Foreign Application Priority Data

Mar. 29, 2013 (JP) ..... 2013-072208

(51) Int. Cl.
*H01J 23/26* (2006.01)
*H01J 23/30* (2006.01)
*H01J 25/34* (2006.01)

(52) U.S. Cl.
CPC *H01J 23/26* (2013.01); *H01J 25/34* (2013.01)

(58) Field of Classification Search
CPC ..... H01J 23/26; H01J 23/30
USPC ..... 315/3.5
See application file for complete search history.

(56) References Cited

U.S. PATENT DOCUMENTS 3,903,449 A * 9/1975 Scott et al. ..... 315/3.5
4,264,842 A * 4/1981 Galuppi ..... 315/3.5
4,358,704 A * 11/1982 Conquest ..... 315/3.5
5,341,066 A * 8/1994 Karsten et al. ..... 315/3.5
5,384,951 A * 1/1995 Karsten et al. ..... 29/600
6,356,022 B1 * 3/2002 Kosmahl ..... 315/3.5
6,356,023 B1 * 3/2002 Kosmahl ..... 315/3.5
2006/0097669 A1 * 5/2006 Teshima et al. ..... 315/500

FOREIGN PATENT DOCUMENTS

GB 1196072 A * 6/1970 ..... H01J 23/30
JP S29-1722 2/1954
JP S58-026157 U 2/1983
JP S58-085251 A 5/1983
JP S63-131439 A 6/1988
JP H05-242817 A 9/1993

(Continued)

OTHER PUBLICATIONS

Toshio Onodera, et al., "Phase Velocity Dispersion of a Solid Metal Segment Loaded Helix as Used in Broadband Traveling Wave Tubes," IEICE Transactions on Electronics (Japanese edition), vol. J70-C, No. 9, pp. 1286-1292, Sep. 1987.

(Continued)

*Primary Examiner* — Alexander H Taningco
*Assistant Examiner* — Kurtis R Bahr
(74) *Attorney, Agent, or Firm* — Wilmer Cutler Pickering Hale and Dorr LLP

(57) ABSTRACT

An electron tube includes a shell that encloses a helix inside, and a plurality of support rods that support and fix the helix inside the shell, a part of each support rod that is in contact with an inner wall of the shell being covered with a conductive material, another part of each support rod that is in contact with the helix being covered with a dielectric material. The widths of conductive material of one end and another end of each support rod in a longitudinal direction are different, the side surface not being in contact with the shell nor the helix.

6 Claims, 5 Drawing Sheets

(56) References Cited

FOREIGN PATENT DOCUMENTS

| | | | |
|---|---|---|---|
| JP | H06-162941 | A | 6/1994 |
| JP | 2006-134751 | A | 5/2006 |
| JP | 2010-519695 | A | 6/2010 |

OTHER PUBLICATIONS

Japanese Office Action with partial English translation for Japanese counterpart to U.S. Appl. No. 14/228,460 dated May 13, 2014 (2 pages).

* cited by examiner

ELECTRON TUBE

This application is based upon and claims the benefit of priority from Japanese patent application No. 2013-072208, filed on Mar. 29, 2013, the disclosure of which is incorporated herein in its entirety by reference.

TECHNICAL FIELD

The present invention relates to an electron tube including a helix that makes an electron beam and an RF (radio frequency) signal that interact with each other.

BACKGROUND ART

Travelling-wave tubes, klystrons and the like are electron tubes used for, e.g., amplification or oscillation of an RF signal by means of interaction between an electron beam emitted from an electron gun and a high-frequency circuit. Electron tube 1, for example, as illustrated in FIG. 1, includes electron gun 10 that emits electrons, helix 20 used as a circuit that makes electron beam 50 formed by the electrons emitted from electron gun 10 and an RF signal that interact with each other, collector electrode 30 that captures electrons output from helix 20, and anode electrode 40 that draws out electrons from electron gun 10 and guides the electrons emitted from electron gun 10 into a helical structure of helix 20. Electron gun 10 includes cathode electrode 11 that emits electrons (thermal electrons), heater 12 that provides cathode electrode 11 with thermal energy for electron emission, and wehnelt electrode 13 that makes electrons emitted from cathode electrode 11 converge to form electron beam 50.

Electrons emitted from electron gun 10, while forming electron beam 50, is accelerated by a difference in potential between cathode electrode 11 and anode electrode 40 and introduced into the helical structure of helix 20. The electrons travel inside the helical structure of helix 20 while interacting with an RF signal input from an end of helix 20. Electron beam 50 that has passed through the inside of the helical structure of helix 20 is captured by collector electrode 30. Here, the RF signal that has been amplified by the interaction with electron beam 50 is output from another end of helix 20.

Collector electrode 30 and electron gun 10 in electron tube 1 illustrated in FIG. 1 are each supplied with a predetermined power supply voltage from power supply apparatus 60. Anode electrode 40 and helix 20 are each connected to a case of electron tube 1 and grounded.

Cathode electrode 11 and wehnelt electrode 13 in electron gun 10 are each supplied with a common negative direct-current high voltage (helix voltage) from power supply apparatus 60, and heater 12 is supplied with the required direct-current or alternate-current voltage with reference to the potential of cathode electrode 11. Also, collector electrode 30 is supplied with a positive direct-current high voltage with reference to the potential of cathode electrode 11. Electron tube 1 may have a configuration in which anode electrode 40 and helix 20 are disconnected and anode electrode 40 is supplied with a positive direct-current voltage with reference to the potential of cathode electrode 11.

As illustrated in FIGS. 2A and 2B, helix 20 is supported and fixed by (normally, three) support rods 22 including a dielectric material, inside shell 21. Vanes 23 (also called "solids") including a metal material are fixed to an inner wall of shell 21. The vanes 23 reduce variation in coupling impedance between an RF signal and electron beam 50 relative to frequency and also reduce variation in phase velocity of the RF signal to broaden a bandwidth of electron tube 1.

A technique that broadens the bandwidth of electron tube 1 by providing vanes inside a shell is also described in, for example, "Phase velocity dispersion of a solid metal segment loaded helix as used in broadband traveling wave tubes" (T. Onodera, Y. Tsuji, IEICE TRANSACTIONS on Electronics (Japanese edition), vol. J70-C, No. 9, pp. 1286-1287, September 1987). In the article, the shell is referred to as a "barrel" and the vanes are referred to as "metal segments."

JP05-242817A describes a configuration in which one or both of the side surfaces of each of support rods (dielectric bodies) that support a helix is/are provided with a split-level portion and the split-level portion is plated with a metal to make the support rods function as vanes, thus eliminating the need for vanes.

Also, JP2006-134751A describes a configuration in which a conductive material is embedded in each of the support rods that support a helix to make the support rods function as vanes, thus eliminating the need for provide vanes.

For example, in a wireless communication system using electron tubes, an increase in the amount of data that can be transmitted/received per unit time can be expected by broadening the bandwidths of the electron tubes. Also, for example, in a radar system using electron tubes, the number of electron tubes covering a predetermined frequency range can be reduced by broadening the bandwidths of the electron tubes, thus enabling a reduction in, e.g., costs of the entire system and/or time required for maintenance.

Therefore, there is a demand for further broadening the bandwidths of electron tubes, and in order to respond to such demand, various studies have been underway. One of such studies relates to the aforementioned technique in which vanes including a metal material are provided inside a shell.

In recent years, there is a further increasing demand for broadening the bandwidths of electron tubes, and thus, it is desirable to provide an electron tube that can be used for a broader frequency band.

SUMMARY

Therefore, an object of the present invention is to provide a technique that enables further broadening of the bandwidth of an electron tube.

In order to achieve the above object, an electron tube according to an exemplary aspect of the present invention is an electron tube including a helix that is used as a circuit that causes an electron beam and an RF (radio frequency) signal interact with each other, the electron tube including:

a shell that encloses the helix inside; and a plurality of support rods that support and fix the helix inside the shell, a part of each support rod that is in contact with an inner wall of the shell being covered with a conductive material, another part of each support rod that is in contact with the helix being covered with a dielectric material, wherein the widths of the conductive material of one end and another end of each support rod in a longitudinal direction, on a side surface of the support rod, are different, the side surface not being in contact with the shell nor the helix.

The above and other objects, features, and advantages of the present invention will become apparent from the following description with reference to the accompanying drawings, which illustrate examples of the present invention.

EXEMPLARY EMBODIMENT

Next, the present invention will be described with reference to the drawings.

First Exemplary Embodiment

Figure 3A:
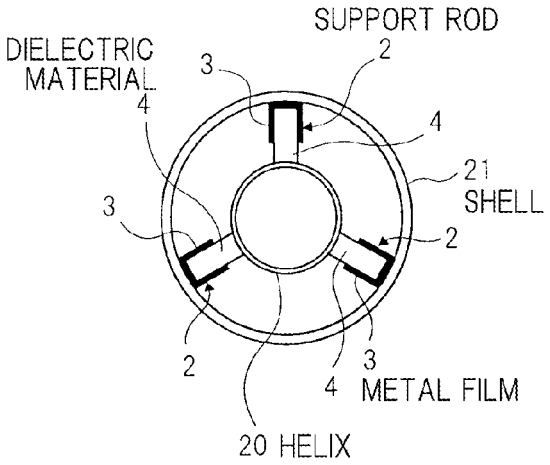
FIG. 3A is a cross-sectional view illustrating an example configuration of an electron tube according to a first exemplary embodiment.
Figure 3B:
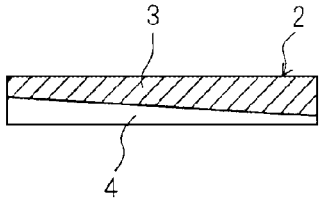
FIG. 3B is a side view illustrating an example configuration of a support rod illustrated in FIG. 3A.

FIG. 3A is a cross-sectional view illustrating an example configuration of an electron tube according to a first exemplary embodiment, and FIG. 3B is a side view illustrating an example configuration of a support rod illustrated in FIG. 3A. FIG. 3A illustrates a cross-section of the electron tube along a direction perpendicular to a direction in which an electron beam flows.

Figure 1:
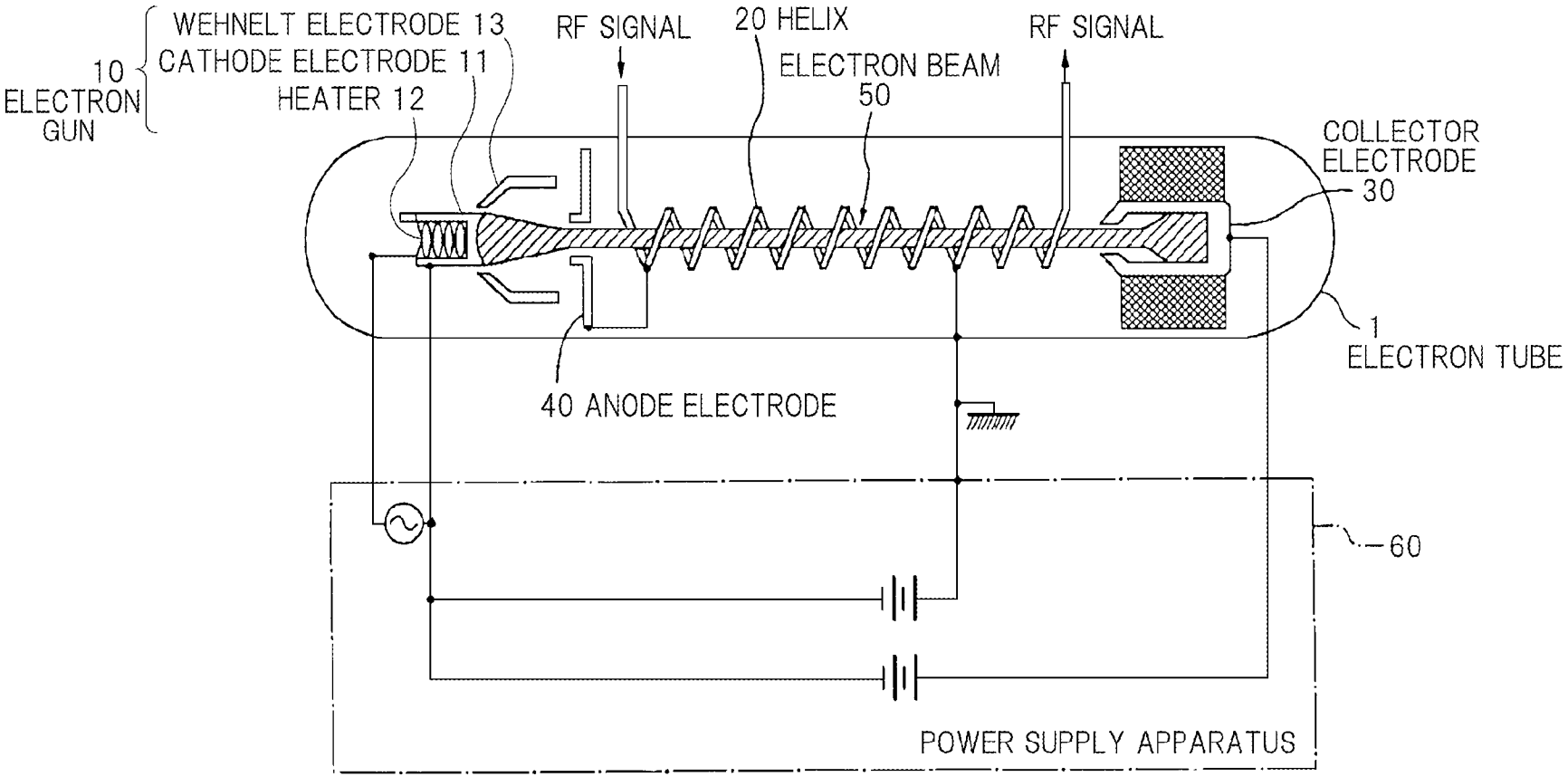
FIG. 1 is a schematic diagram illustrating an example configuration of an electron tube including a helix.
Figure 2A:
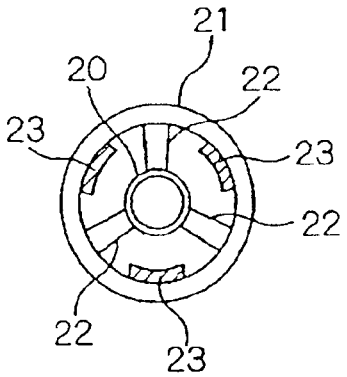
FIG. 2A is a cross-sectional view illustrating a support structure for the helix illustrated in FIG. 1.
Figure 2B:
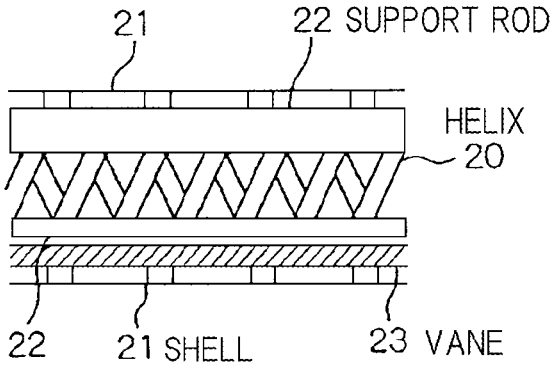
FIG. 2B is a side cross-sectional view illustrating the support structure for the helix illustrated in FIG. 1.

As illustrated in FIGS. 3A and 3B, electron tube 1 according to the first exemplary embodiment has a configuration that eliminates the need for vanes, and support rods 2 for supporting helix 20 each have a structure that is different from that of electron tube 1 in the related art, which is illustrated in FIGS. 1, 2A and 2B. The rest of the configuration is similar to that of electron tube 1 in the related art, which is illustrated in FIGS. 1, 2A and 2B, and thus, a description thereof will be omitted here.

As illustrated in FIGS. 3A and 3B, each of support rods 2 used in electron tube 1 according to the present exemplary embodiment has a configuration in which metal film 3 including a conductive material is formed on surfaces of the principal material including dielectric material 4 and the face of the support rod that is in contact with an inner wall of shell 21 and both of the side surfaces of the support rod that are not in contact with helix 20 are covered by metal film 3. In the part of each of support rods 2 that is in contact with helix 20, dielectric material 4 is exposed. Accordingly, when helix 20 is fixed, metal film 3 in each of support rods 2 is in contact with the inner wall of shell 21.

As illustrated in FIG. 3B, the widths of metal film 3 (conductive material) of one end and another end of each support rod 2 in a longitudinal direction, on the side surfaces that are not in contact with shell 21 nor helix 20, are different, and metal film 3 is formed in, for example, a tapered shape so that the width gradually increases from the one end toward the other end.

Support rods 2 are arranged so that the widths of metal film 3 of the one end, in the longitudinal direction that is smaller, is positioned on the entrance side (electron gun 10 side) through which electrons enter the inside of a helical structure of helix 20 and the width of metal film 3 of the other end, in the longitudinal direction that is larger, is positioned on the exit side (collector electrode 30 side) through which electrons exit from the inside of the helical structure of helix 20.

Figure 4A:
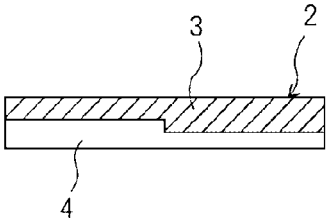
FIG. 4A is a side view illustrating an alteration of the support rod illustrated in FIGS. 3A and 3B.
Figure 4B:
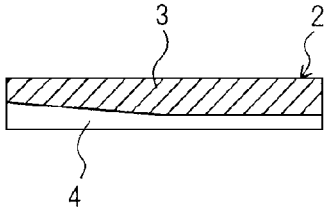
FIG. 4B is a side view illustrating an alteration of the support rod illustrated in FIGS. 3A and 3B.

Metal film 3 on the side surfaces in the longitudinal direction of each support rod does not need to have the tapered shape illustrated in FIG. 3B, and may have any shape as long as the widths of metal film 3 of one end and the other end, in the longitudinal direction of each support rod 2, are different. For example, the shape of metal film 3 on the side surfaces of each support rod may be a stepped shape as illustrated in FIG. 4A, a shape including a tapered portion and a fixed width portion as illustrated in FIG. 4B, or a shape including a tapered portion, a fixed width portion and a stepped portion, which is a combination of the above shapes.

Although FIGS. 3A and 3B indicate an example in which metal film 3 is formed on both of side surfaces of plate-like dielectric material 4, metal film 3 may be formed only one of the side surfaces of dielectric material 4. Also, dielectric material 4, which is a principal material of each support rod 2, does not need to have a plate-like shape, and may have any shape such as a trapezoidal shape or an L shape in a cross-section as long as such shape enables helix 20 to be fixed inside shell 21.

For dielectric material 4, which is a principal material of each support rod 2, for example, beryllium oxide or boron nitride is used, and for metal film 3, e.g., gold or copper is used. Metal film 3 may be formed on surfaces of dielectric material 4 using a known vacuum deposition method or a known sputtering method. If beryllium oxide is used as dielectric material 4, a film of, e.g., gold may be formed on the surfaces of dielectric material 4 after metallization of the surfaces.

Also, although FIGS. 3A and 3B indicate an example in which support rods 2 with metal film 3 formed on the surfaces of plate-like dielectric material 4 are used, each of support rods 2 may have a configuration in which a conductive material such as a metal is embedded in dielectric material 4 as indicated in JP2006-134751A mentioned above. In such case, also, dielectric material 4 and the conductive material may be formed so that the widths of the conductive material in support rod 2 of one end and the other end, in the longitudinal direction of each support rod 2, are different.

In electron tube 1 according to the present exemplary embodiment, as with vanes 23 illustrated in FIGS. 2A and 2B, metal film 3 formed in each support rod 2 reduces variation in coupling impedance between an RF signal and electron beam 50 relative to frequency and also reduces variation in phase velocity relative to frequency of the RF signal, and thereby contributes to broadening of a bandwidth of electron tube 1. Thus, the need for vanes 23 illustrated in FIGS. 2A and 2B is eliminated.

In order to make electron beam 50 and an RF signal interact with each other inside the helical structure of helix 20 included in electron tube 1 described above, it is necessary that the electrons have a velocity substantially equal to a phase velocity of the RF signal. An RF signal has a velocity substantially equal to the speed of light when the RF signal propagates while traveling straight in a vacuum. Meanwhile, the velocity of electrons flowing between two electrodes in a vacuum does not reach the speed of light even if a difference in potential between the electrodes is increased.

Therefore, in electron tube 1 such as a traveling-wave tube, an RF signal is made to propagate in helix 20 having a helical shape to bring the phase velocity of the RF signal in an axial direction of helix 20 close to the velocity of electrons travelling inside the helical structure.

In helix 20, a high frequency electric field is generated by an RF signal, and electrons that have entered the inside of the helical structure of helix 20 are decelerated or accelerated by the high frequency electric field (velocity modulation). If a velocity of electrons travelling inside the helical structure and a phase velocity of an RF signal are exactly equal to each other, the amount of electrons decelerated and the amount of electrons accelerated are equal to each other, causing no interaction between the electron beam and the RF signal, and thus, the RF signal is not amplified. Meanwhile, if the velocity of electrons traveling inside the helical structure is set to be slightly larger than the phase velocity of an RF signal, a high-density group of electrons is generated in a decelerated electron region of a high frequency electric field generated by the RF signal. In the decelerated electron region, electrons are decelerated and the difference in motion energy between the velocity subsequent to the deceleration and an initial velocity is converted into high-frequency energy. Consequently, the high frequency electric field generated by the RF signal is intensified, and the intensified high frequency electric field facilitates modulation of the velocity of the electrons, whereby the high frequency electric field generated by the RF signal is further intensified. As a result of such interaction continuing along with travelling of the electron beam and the RF signal, the energy of the RF signal increases as the RF signal comes closer to an output end of helix 20. As a result, the RF signal input from one end of helix 20 (cathode 11 side) is amplified and output from another end (collector 30 side).

The present applicants found that a phase velocity of an RF signal propagating in helix 20 is decreased by forming metal film 3 in each support rod 2 and the phase velocity of the RF signal depends on the width of metal film 3 formed in each support rod 2.

Figure 5:
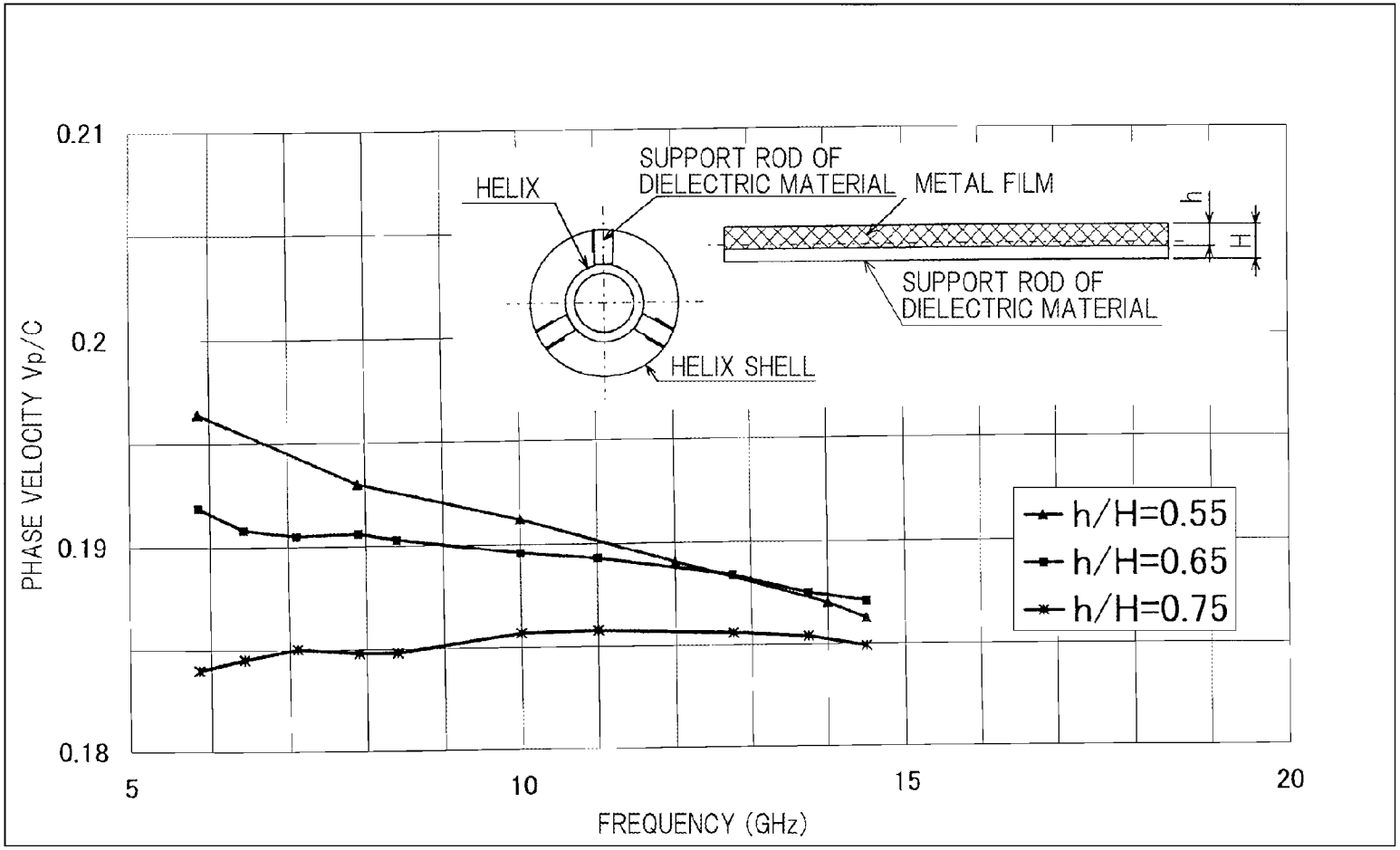
FIG. 5 is a graph indicating variations in phase velocity relative to the frequency of an RF signal input to a helix.

FIG. 5 is a graph indicating variations in phase velocity relative to the frequency of an RF signal input to helix 20. FIG. 5 indicates variations in phase velocity (Vp/C where C is the speed of light) of an RF signal relative to the frequency of the RF signal when width h of metal film 3 is varied relative to width H of each support rod including dielectric material 4. Metal film 3 is formed so as to have even width h in each support rod 2 in order to achieve h/H=0.55, 0.65 and 0.75.

As illustrated in FIG. 5, a phase velocity of an RF signal propagating in helix 20 depends on the width of metal film 3 formed in each support rod 2, and if metal film 3 with relatively large width h is formed, the phase velocity of the RF signal is substantially fixed over a wide frequency range. Thus, broadening of the bandwidth of electron tube 1 can be expected. However, as illustrated in FIG. 5, if metal film 3 is formed so as to have large width h, the phase velocity of the RF signal becomes very low.

As described above, in order to make electron beam 50 and an RF signal interact with each other, it is necessary to set a velocity of the electron beam to be slightly higher than the phase velocity of the RF signal propagating in helix 20 having a helical shape. Thus, if the phase velocity of the RF signal is low, it is necessary to decrease the velocity of electron beam 50. In other words, energy that can be obtained from electron beam 50 is reduced, thus lowering the gain of electron tube 1, which results in limiting the output power of the RF signal.

Therefore, in the present exemplary embodiment, the width of metal film 3 in the side surfaces of each support rod is varied in the longitudinal direction. The width of metal film 3 in each support rod 2 is set so that the width is smaller at one end on the electron gun 10 side in which electron beam 50 has a high velocity and is larger at the other end on the collector electrode 30 side along with a decrease in velocity of electron beam 50. As described above, formation of metal film 3 makes an RF signal that propagates in helix 20 and electron beam 50 interact with each other in a wider frequency range. Thus, the phase velocity of the RF signal can be made to be substantially fixed in a wider frequency range while a decrease in phase velocity of the RF signal is reduced. Accordingly, the bandwidth of electron tube 1 can be further broadened while a decrease in the gain of electron tube 1 is reduced.

Also, as described above, the velocity of electrons emitted from electron gun 10 is accelerated by the difference in potential between cathode electrode 11 and anode electrode 40 or helix 20, reaches the maximum, and is gradually decelerated by interaction with an RF signal during the process of passing through the inside of the helical structure of helix 20. Thus, there are electron tubes (traveling-wave tubes) 1 having a configuration in which helix 20 has a varying pitch (helical period) in order to vary the phase velocity of an RF signal along with variation in velocity of electrons.

In electron tube 1 according to the present exemplary embodiment, the phase velocity of an RF signal can be varied by varying the width of metal film 3 formed in each support rod 2, and thus, there is no need for preparing helix 20 with a varying pitch (helical period). Accordingly, the manufacture of helix 20 is facilitated.

Second Exemplary Embodiment

Figure 6A:
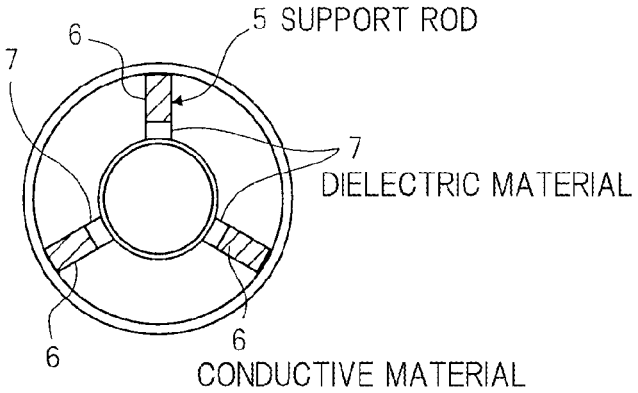
FIG. 6A is a cross-sectional view illustrating a configuration of an electron tube according to a second exemplary embodiment.
Figure 6B:
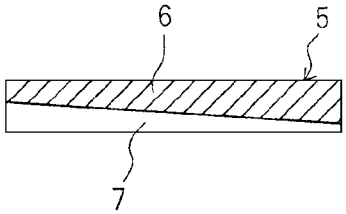
FIG. 6B is a side view illustrating an example configuration of a support rod illustrated in FIG. 6A.

FIG. 6A is a cross-sectional view illustrating the configuration of an electron tube according to a second exemplary embodiment, and FIG. 6B is a side view illustrating an example configuration of a support rod illustrated in FIG. 6A. FIG. 6A illustrates a cross-section of the electron tube along the direction perpendicular to a direction in which an electron beam flows.

As illustrated in FIGS. 6A and 6B, each of support rods 5 included in the electron tube according to the second exemplary embodiment has a configuration in which conductive material 6 is arranged in a part of support rod 5 that is in contact with an inner wall of shell 21, dielectric material 7 is arranged in a part of support rod 5 that is in contact with helix 20, and conductive material 6 and dielectric material 7 are joined to each other. Also, as in the first exemplary embodiment, the widths of conductive material 6 of one end and another end of each support rod 5 in longitudinal direction, in the side surfaces of support rod 5 that are not in contact with shell 21 nor helix 20, are different, and the width of conductive material 6 is formed in, for example, a tapered shape so that the width gradually increases from the one end toward the other end. The shape of conductive material 6 in the side surfaces of each support rod may be a stepped shape as illustrated in FIG. 4A, a shape including a tapered portion and a fixed width portion illustrated in FIG. 4B or a shape including a tapered portion, a fixed width portion and a stepped portion, which is a combination of the above shapes. The rest of the configuration is similar to that of electron tube 1 according to the first exemplary embodiment, and thus, a description thereof will be omitted.

In the electron tube according to the present exemplary embodiment, e.g., copper or graphite, which is a non-magnetic substance, is used for conductive material 6, and, e.g., boron nitride or aluminum nitride is used for dielectric material 7. Conductive material 6 and dielectric material 7 may be joined to each other by means of, e.g., brazing after, for example, metallization of a join surface of dielectric material 7.

With such configuration as described above, also, conductive material 6 in each support rod 5 contributes to broadening of the bandwidth of electron tube 1 instead of vanes 23 illustrated in FIGS. 2A and 2B as in the first exemplary embodiment. Thus, the bandwidth of electron tube 1 can be broadened while a decrease in the gain of electron tube 1 is reduced.

Furthermore, a phase velocity of an RF signal can be varied by varying the width of conductive material 6 formed in each support rod 5, thus eliminating the need to prepare helix 20 having a varying pitch. Accordingly, the manufacture of helix 20 is facilitated.

While the invention has been particularly shown and described with reference to exemplary embodiments thereof, the invention is not limited to these embodiments. It will be understood by those ordinarily skilled in the art that various changes in form and details may be made therein without departing from the spirit and scope of the present invention as defined by the claims.

The invention claimed is:

1. An electron tube including a helix used as a circuit that makes an electron beam and an RF (radio frequency) signal interact with each other, said electron tube comprising:

a shell that encloses said helix inside; and a plurality of support rods that support and fix said helix inside said shell, a part of each support rod that is in contact with an inner wall of said shell being covered with a conductive material, another part of each support rod that is in contact with said helix being covered with a dielectric material, wherein the widths of said conductive material of one end and another end of each support rod in a longitudinal direction, on a side surface of said support rod, are different, the side surface not being in contact with said shell nor said helix, wherein each of said support rods is arranged so that:

the one end in the longitudinal direction of said support rod is positioned on an entrance side through which an electron enters an inside of a helical structure of said helix, said conductive material having a smaller width at the one end; and the other end in the longitudinal direction of said support rod is positioned on an exit side through which the electron exits from the inside of the helical structure of said helix, said conductive material having a larger width at the other end.

2. The electron tube according to claim 1, wherein said conductive material has a tapered shape on the side surface in the longitudinal direction of each of said support rods.

3. The electron tube according to claim 1, wherein said conductive material has a stepped shape on the side surface in the longitudinal direction of each of said support rods.

4. The electron tube according to claim 1, wherein said conductive material has a shape including a tapered portion and a fixed width portion on the side surface in the longitudinal direction of each of said support rods.

5. The electron tube according to claim 1, wherein said conductive material has a shape including a tapered portion, a fixed width portion and a stepped portion on the side surface in the longitudinal direction of each of said support rods.

6. The electron tube according to claim 1, wherein a metal film including said conductive material is formed on a surface of a principal material of each of said support rods, the principal material including said dielectric material, and a face of said support rod in contact with the inner wall of said shell and the side surface of said support rod that are not in contact with said helix are covered by said metal film.

* * * * *